US005498009A

United States Patent [19]

Young

[11] Patent Number: 5,498,009

[45] Date of Patent: Mar. 12, 1996

[54] ICE SKATE WITH AN EXTENDIBLE SOLE PLATE

[76] Inventor: Gang Young, No. 19, Lane 90, Chingli St, Tucheng Hsiang, Taipei Hsien, Taiwan

[21] Appl. No.: 490,244

[22] Filed: Jun. 14, 1995

[51] Int. Cl.[6] ..... A63C 1/06

[52] U.S. Cl. ..... 280/11.12; 280/11.26; 280/11.32

[58] Field of Search ..... 280/11.12, 441, 280/11.26, 7.13, 7.14, 11.32, 11.33

[56] References Cited

U.S. PATENT DOCUMENTS

| | | | |
|---|---|---|---|
| D. 182,518 | 4/1958 | Jones et al. | 280/11.12 |
| 2,290,523 | 7/1942 | Bauer | 280/11.26 |
| 4,114,295 | 9/1978 | Schaefer | 280/11.12 |
| 5,354,077 | 10/1994 | Soo | 280/11.12 |

*Primary Examiner*—Richard M. Camby

*Attorney, Agent, or Firm*—Testa, Hurwitz & Thibeault

[57] ABSTRACT

An ice skate includes an extendible sole composed of a front plate and a rear plate, a longitudinal receptacle formed under the rear plate, a plurality of bores defined in walls of the receptacle, a plurality of holes defined on the rear plate, an extension member protruding from a bottom of the front plate so as to be slidably received by the receptacle. A plurality of longitudinal slots facing the bores on the walls of the receptacle are further defined in the extension member, a first corresponding number of screws extending through the bores on the walls of the receptacle and the longitudinal slots for slidably adjusting a length of the sole and securing the front plate in place, a blade integrally formed of a fixation board adhered under the front plate and a stanchion having a plurality of longitudinal grooves facing the holes on the rear plate, a second corresponding number of screws extending through the longitudinal grooves and the holes on the rear plate for slidably adjusting the blade in accordance with the length of the sole and securing the blade in place, and a plurality of straps provided on the front plate and the rear plate for securing a user's foot therein.

4 Claims, 6 Drawing Sheets

ICE SKATE WITH AN EXTENDIBLE SOLE PLATE

BACKGROUND OF THE INVENTION

The present invention relates to an ice skate, and particularly to an ice skate with an extendible sole plate.

A conventional ice skate is composed of a boot having a vamp and a sole and a blade directly secured under the sole. However, as the vamp and the sole of the boot merely present one size, the conventional ice skate can only be used for a short-term utilization. Particularly, as many ice skaters ate teenagers with rapidly growing feet, the skaters have to purchase several pairs of ice skates in accordance with changes in foot size.

Further, it is inconvenient for skaters to have to take off shoes before putting on the ice skates.

SUMMARY OF THE INVENTION

An object of the present invention is to provide an ice skate with a longer utilization duration.

Another object of the present invention is to provide an ice skate which can be worn simultaneously with existing footware.

According to the present invention, the ice skate includes an extendible sole composed of a front plate and a rear plate, a longitudinal receptacle formed under the rear plate, a plurality of bores defined in walls of the receptacle, a plurality of holes defined on the rear plate, an extension member protruding from a bottom of the front plate so as to be slidably received by the receptacle. A plurality of longitudinal slots facing the bores in the walls of the receptacle are further defined in the extension member, a first corresponding number of screws extending through the bores on the walls of the receptacle and the longitudinal slots for slidably adjusting a length of the sole and securing the front plate in place, a blade integrally formed of a fixation board adhered under the front plate and a stanchion having a plurality of longitudinal grooves facing the holes on the rear plate, a second corresponding number of screws extending through the longitudinal grooves and the holes on the rear plate for slidably adjusting the blade in accordance with the length of the sole and securing the blade in place, and a plurality of straps provided on the front plate and the rear plate for securing the ice skate to a player's foot.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
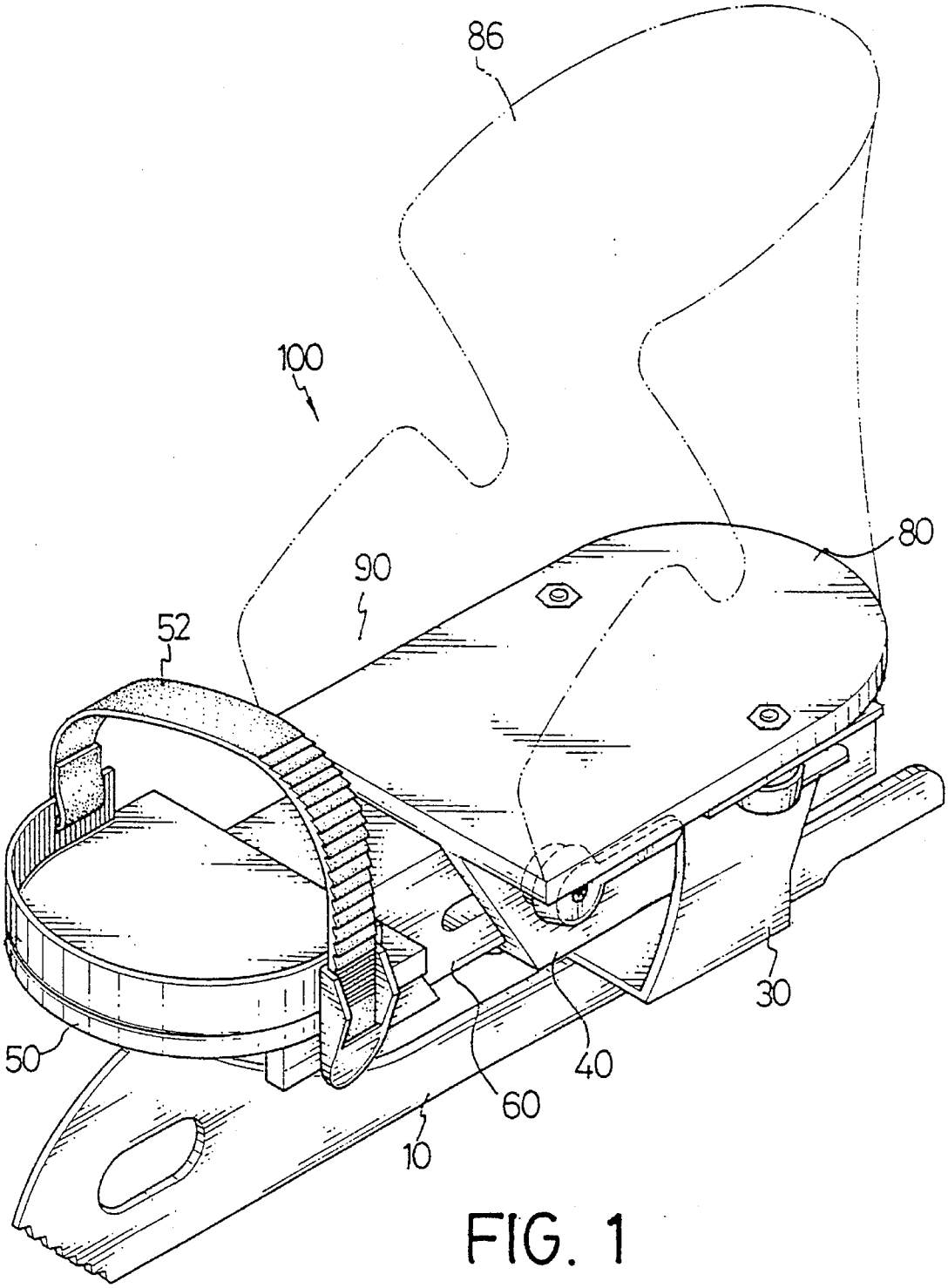
FIG. 1 is a perspective view of an ice skate according to a first embodiment of the present invention.

Referring now to drawings wherein like reference characters designate identical or corresponding parts through the several views. Referring to FIG. 1, there is shown a perspective view of an ice skate 100 in accordance with a first embodiment of the present invention. As shown, the ice skate 100 includes a sole assembly 90, a blade 10, a stanchion 30 connected between the sole assembly 90 and the blade 10. The sole assembly 90 is composed of a front plate 50, an extension bridge 60 protruding from a bottom of the front plate 50, a rear plate 80, a longitudinal receptacle 40 provided under the rear plate 80 and defining a channel for slidably receiving the extension bridge 60, a strap 52 provided on the front plate 50, and a cuff 86 (shown in phantom lines) secured on the rear plate 80.

Figure 2:
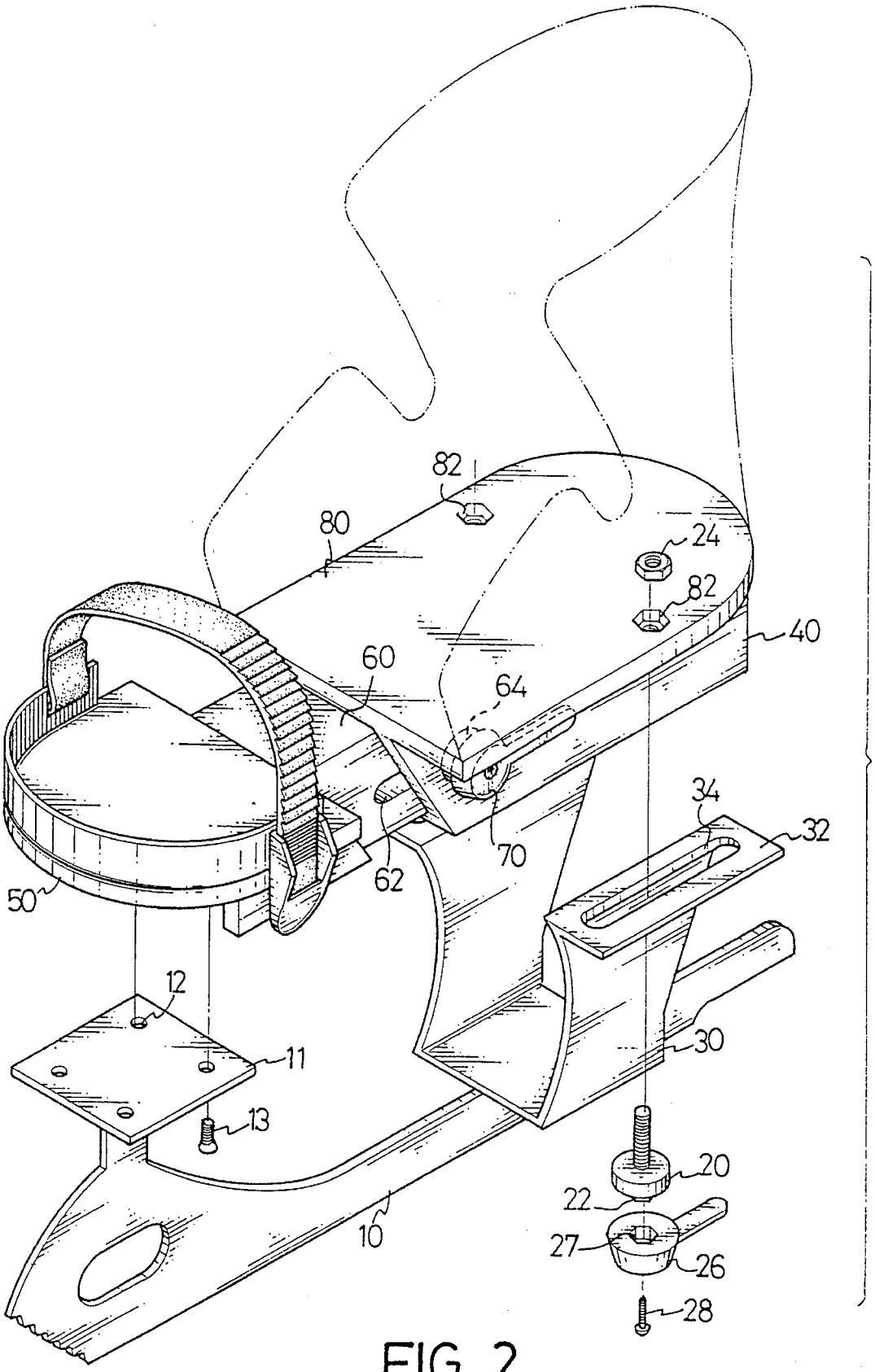
FIG. 2 is a perspective view partially exploded of an ice skate according to the present invention.
Figure 3:
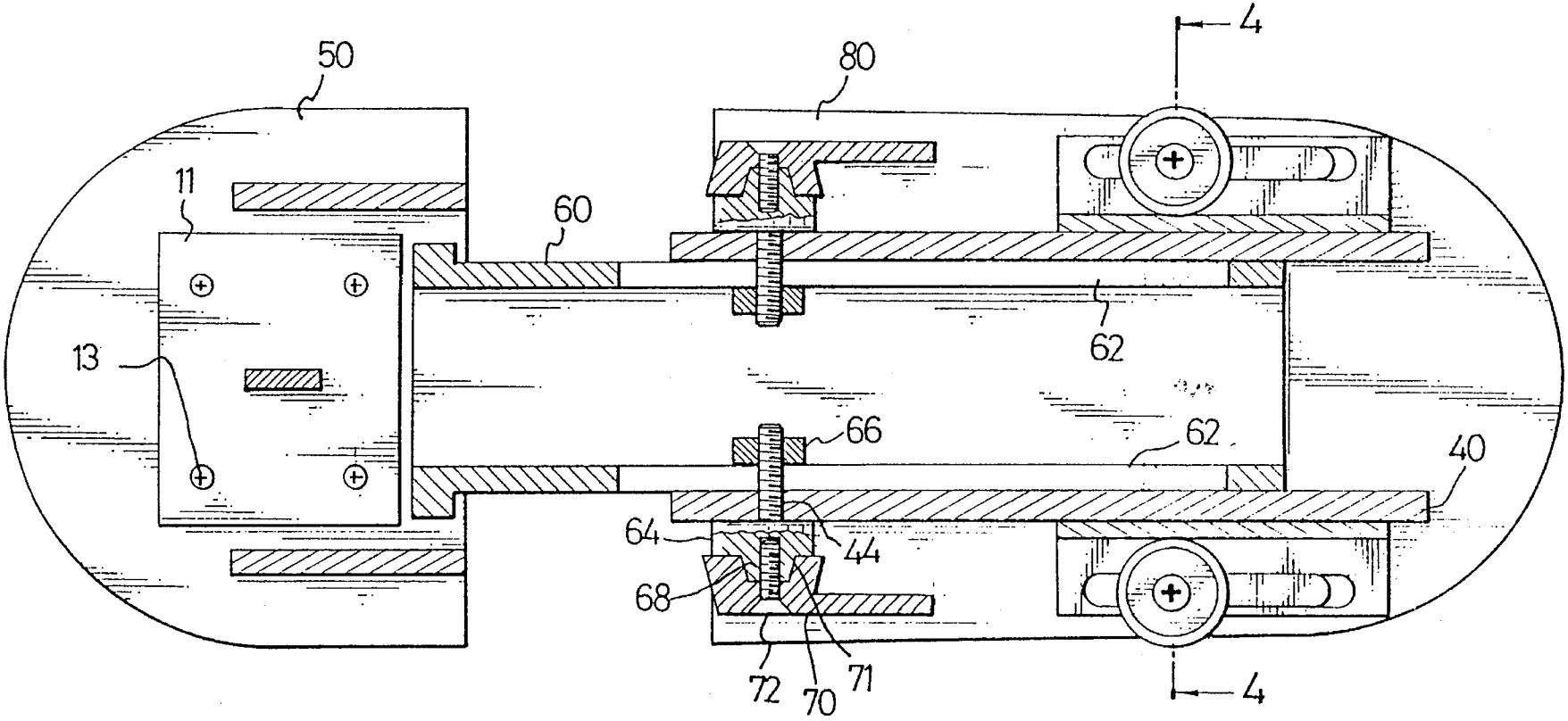
FIG. 3 is a cross-sectional view of an ice skate according to the present invention.

Referring to FIGS. 2 and 3, the rear plate 80 has two holes 82 each with an enlarged hexagonal opening for a hex nut 24 to be received therewithin, the extension bridge 60 (in FIG. 4) has a U-shaped cross-section with a longitudinal slot 62 formed on oppositely-faced walls of the bridge 60, the receptacle 40 is formed by two faced J-shaped cross-section bars 42 (in FIG. 4) protruding from the rear plate 80 with an inner dimension sized to marginally receive the extension bridge 60. A bore 44 facing the slot 62 is respectively provided on oppositely-faced walls of the receptacle 40 for a respective bolt 64 to extend through the bore 44 and the slot 62 so as to secure the extension bridge in place with a nut 66 thereby adjusting the corresponding relation between the extension bridge 60 and the receptacle 40, i.e., a length of the sole assembly.

A fixation board 11 is integrally formed on the blade 10, a plurality of apertures 12 are provided on the board 11 for a corresponding number of screws 13 to extend therethrough thereby securing the board 11 under the front plate 50. The stanchion 30 is a longitudinal frame of U-shaped cross-section with a wing piece 32 on each end of the stanchion 30, a longitudinal groove 34 facing the hole 82 is respectively defined in each wing piece 32 for a bolt 20 to extend through and couple with the nut 24 thereby securing the stanchion 30 in place.

The screws 20, 64 respectively have a hex head 22, 68 of integrally formed for a wrench 26, 70 to attach onto the screws 20, 64. The hex head 22, 68 further forms a threaded hole. The wrench 26, 70 has a passage 27,71 with an enlarged hex opening coincided with the threaded hole for marginally receiving the hex head 22, 68 and a screw 28, 72 to extend through the passage 27, 71 and the threaded hole in hex head 22, 68 thereby securing the wrench 26, 70 onto the screw 20, 64.

Figure 4:
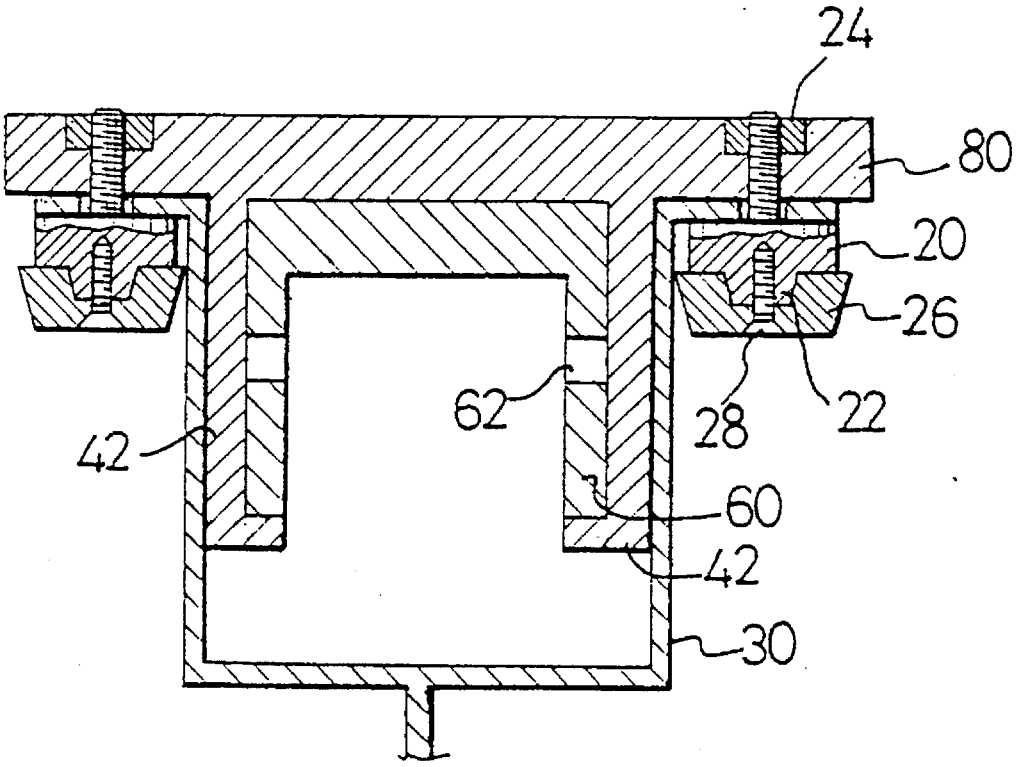
FIG. 4 is a cross-sectional view of an ice skate taken along line 4—4 of FIG. 3.

As shown in FIGS. 3 and 4, the extension bridge 60 is marginally fastened onto the receptacle 40 by the screw 64 and the nut 66, the stanchion 30 is marginally fastened onto the rear board 80 by means of the screw 20 and the nut 24. Then, the wrench 26, 70 is respectively attached onto the screw 20, 64 by means of the screw 28, 72. Thus, the wrenches 26, 70 may be used to unfasten the extension bridge 60 from the receptacle 40 and the stanchion 30 from the rear board 80 for a user to adjust the length of the sole assembly by pivotally turning the wrench 70, 26. When a desired length of the sole assembly is achieved, the user may fasten the sole assembly by turning back the wrench 70, 26.

Figure 5:
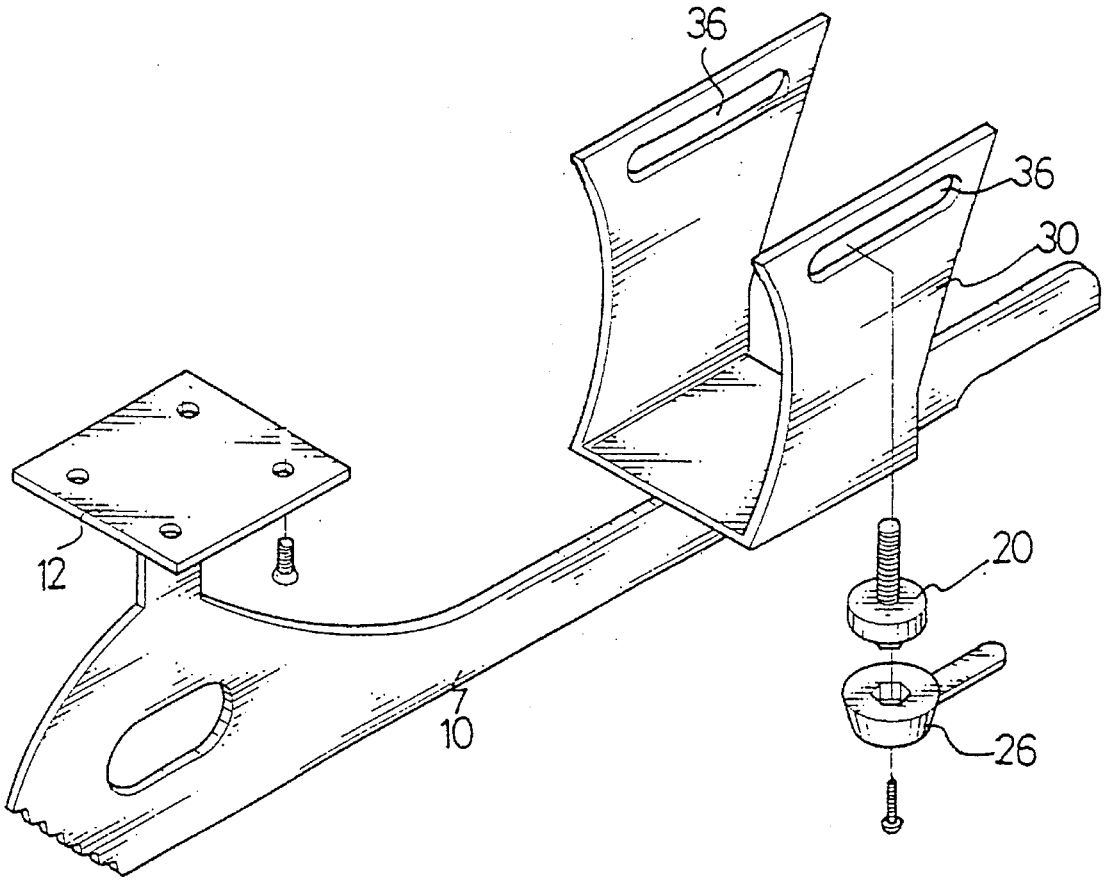
FIG. 5 is a perspective view of a blade according to a second embodiment of the present invention.
Figure 6:
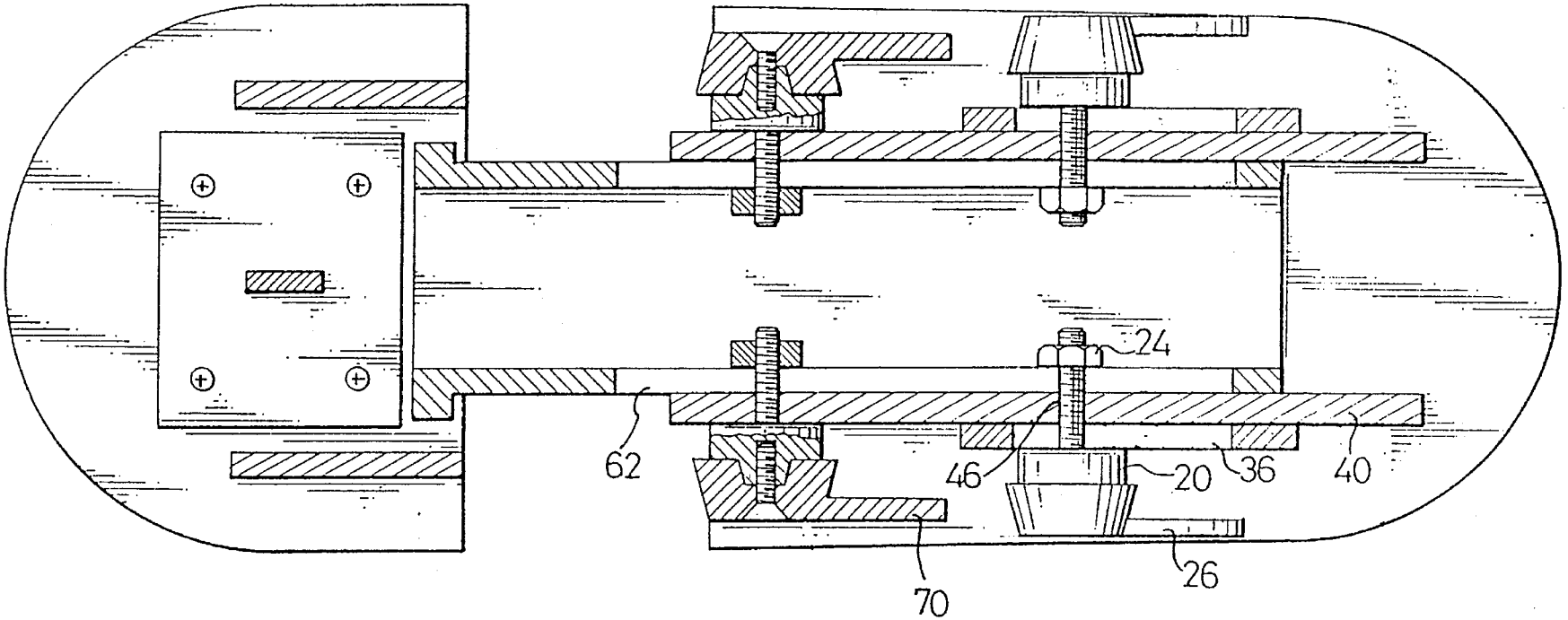
FIG. 6 is a cross-sectional view of an ice skate in cooperation with a blade in FIG. 5.

An alternative embodiment of the present invention is shown in FIGS. 5 and 6, the U-shaped stanchion 30 may directly form a longitudinal groove 36 on each end thereof and an aperture 46 facing the groove 36 is defined on the receptacle 40 so that the stanchion 30 may be secured onto the receptacle 40 by having a screw 20 extend through the groove 36, the aperture 46, and the slot 62 and engaged with a nut 24. Thus, the user may adjust the length of the sole by pivotally turning wrenches 70, 26 in a way similar to that described in the first embodiment.

Although the invention has been explained in relation to its preferred embodiment, it is to be understood that many other possible modifications and variations can be made without departing from the spirit and scope of the invention as hereinafter claimed.

What is claimed is:

1. An ice skate comprising:

an extendible sole formed of a front plate and a rear plate having a plurality of straps provided on the front plate and the rear plate for holding a user's foot;

a longitudinal receptacle formed under the rear plate;

a plurality of bores defined in walls of the receptacle;

a plurality of holes defined on the rear plate;

a longitudinal extension member provided under the front plate and protruding out of the front plate so as to be slidably received by the receptacle;

a plurality of longitudinal slots, facing the bores on the walls of the receptacle, formed on the extension member;

a first corresponding number of screws extending through the bores on the walls of the receptacle and the longitudinal slot for slidably adjusting a length of the sole and securing the front plate in place;

a blade integrally formed of a fixation board adhered under the front plate and a stanchion having a plurality of longitudinal grooves facing the holes on the rear plate; and a second corresponding number of screws extending through the longitudinal grooves and the holes on the rear plate for slidably adjusting the blade in accordance with the length of the sole and securing the blade in place.

2. An ice skate as claimed in claim 1 further comprising a plurality of wrenches secured onto corresponding heads of the screws for tightening and loosening the screws thereby adjusting the length of the extendible sole.

3. An ice skate comprising:

an extendible sole formed of a front plate and a rear plate having a plurality of straps provided on the front plate and the rear plate for holding a user's foot;

a longitudinal receptacle formed under the rear plate;

a plurality of bores and holes defined in walls of the receptacle;

a longitudinal extension member provided under the front plate and protruding out of the front plate so as to be slidably received by the receptacle under the rear plate;

a plurality of longitudinal slots, facing the bores on the walls of the receptacle, formed on the extension member;

a first corresponding number of screws extending through the bores on the walls of the receptacle and the longitudinal slots for slidably adjusting a length of the sole and securing the front plate in place;

a blade integrally formed of a fixation board adhered under the front plate and a stanchion having a longitudinal groove facing the holes on the walls of the receptacle; and a second corresponding number of screws extending through the longitudinal groove and the holes on the wall of the receptacle for slidably adjusting the blade in accordance with the length of the sole and securing the blade in place.

4. An ice skate as claimed in claim 3 further comprising a plurality of wrenches secured onto corresponding heads of the screws for tightening and loosening the screws thereby adjusting the length of the extendible sole.

* * * * *